United States Patent [19]

Armstrong

[11] Patent Number: 4,890,769

[45] Date of Patent: Jan. 2, 1990

[54] BEVERAGE DISPENSER LOCK

[76] Inventor: Richard R. Armstrong, 564 Ka Awakea Rd., Kailua, Hi. 96734

[21] Appl. No.: 357,096

[22] Filed: May 26, 1989

[51] Int. Cl.[4] ..... B67D 5/32

[52] U.S. Cl. ..... 222/153; 70/14; 70/58; 70/159; 70/164; 141/97.

[58] Field of Search ..... 70/14, 57, 58, 159–164, 70/202, 203, 211, 212, DIG. 58; 141/97, 98; 222/153

[56] References Cited

U.S. PATENT DOCUMENTS

| | | | |
|---|---|---|---|
| 2,150,025 | 3/1939 | Cook, Jr. et al. | 222/153 X |
| 2,462,951 | 3/1949 | Doubble | 222/153 X |
| 2,661,135 | 12/1953 | Fraser | 222/153 X |
| 4,459,832 | 7/1984 | Avrea et al. | 70/14 |

FOREIGN PATENT DOCUMENTS

| | | | |
|---|---|---|---|
| 21772 | 6/1900 | Switzerland | 222/153 |
| 1206333 | 9/1970 | United Kingdom | 70/14 |

*Primary Examiner*—Lloyd A. Gall
*Attorney, Agent, or Firm*—Jack C. Munro

[57] ABSTRACT

A lock for a hand-held beverage dispenser which includes a dispensing spout. This beverage dispenser normally is activatable to select any one of several different types of beverages. During non-usage, the beverage dispenser is to be locatable within the internal chamber of a beverage dispenser lock. This beverage dispenser lock is composed of a base plate and a cover with this cover being pivotably mounted on the base plate between an open position and a closed position. When in the closed position, the beverage dispenser is to be confined between the base plate and the cover and access to the beverage dispenser prevented. When in the closed position, the cover is to be locked by a separate locking mechanism. When the cover is in the open position, the beverage dispenser can be moved into and out of the internal chamber.

4 Claims, 1 Drawing Sheet

BEVERAGE DISPENSER LOCK

BACKGROUND OF THE INVENTION

The field of this invention relates to locking mechanisms and more particularly to a locking mechanism for a beverage dispenser that is designed to dispense a plurality of different beverages.

Commercial establishments such as bars and restaurants normally use a device known as a beverage dispenser to facilitate dispensing of different types of beverages. A beverage dispenser comprises a hand-held dispenser device which includes a spout. On the dispensing device are a plurality of buttons. The operator is to push one of the buttons which will dispense a particular type of beverage through the spout and into a container such as a glass. As long as the particular button is pushed, the beverage dispenser will continue to dispense that particular beverage.

This hand-held dispensing device is connectable through a supply conduit to a source of supply for the beverages. A common source of supply would be a plurality of different pressurized tanks with each tank including a quantity of a particular beverage. The advantage of this type of dispensing system is that the bar or restaurant only need to have exposed the particular hand-held dispensing device with the containers for the beverages being located some spaced distance from the dispensing device. Frequently, the containers are located in an out-of-the-way location such as in a back room of the bar or restaurant.

Although these types of dispensers facilitate the dispensing of beverages, these dispensers also facilitate unauthorized usage. During a time that the dispenser is not being utilized, any individual can come along an pick up the dispenser and dispense a quantity of a particular beverage. In essence, this constitutes a theft. Within certain establishments, this unauthorized use of beverage dispensers amounts to a substantial amount of lost revenue.

In the past, in order to curtail this unauthorized usage of beverage dispensers, there have been efforts to lock such beverage dispensers when such are not being used. These efforts are usually directed to some form of a cover with this cover being chained and locked in some form or another. However, in the past, these locking devices have been rather archaic and there has been little effort toward utilizing such a locking device that can be quickly installed, quickly unlocked, and in appearance attractive which is desirable as such is normally observed by patrons.

SUMMARY OF THE INVENTION

The structure of the present invention is directed to a locking device for a hand-held beverage dispenser which is composed of a base plate which has an enlarged opening. Pivotally attached to the upper end of the base plate is a channel shaped cover. This cover is to be movable between a closed position in conjunction with the base plate to an open position. When in the open position, the beverage dispenser is to be movable into and out of connection with the enlarged opening of the base plate. When the cover is in the closed position, the beverage dispenser is not capable of being disengaged from the base plate. The activating buttons, which function the dispensing of beverages from the beverage dispenser, are not capable of being operated when the cover is in the closed position. With the cover in the closed position, a locking pin is utilized to secure the cover in the closed position. This locking pin is to be connectable with a separate locking mechanism. The exterior upper surface of the cover includes a raised section which internally provides clearance for the operating buttons of the beverage dispenser. Also, the exterior surface of this raised section is receptive to the addition of name identifying indicia.

The primary objective of the present invention is to construct a beverage dispenser lock which is constructed of few parts, can be quickly and easily operated by even the most unskilled individual, and can be manufactured relatively inexpensively and thereby sold to the ultimate consumer at a relatively inexpensive price.

Another objective of the beverage dispenser lock of the present invention is to construct an apparatus which not only prevents unauthorized usage of the beverage dispenser but also is attractive in appearance as it is being used and facilitates the application thereto of advertising and/or identifying indicia.

DETAILED DESCRIPTION OF THE SHOWN EMBODIMENT

Figure 1:
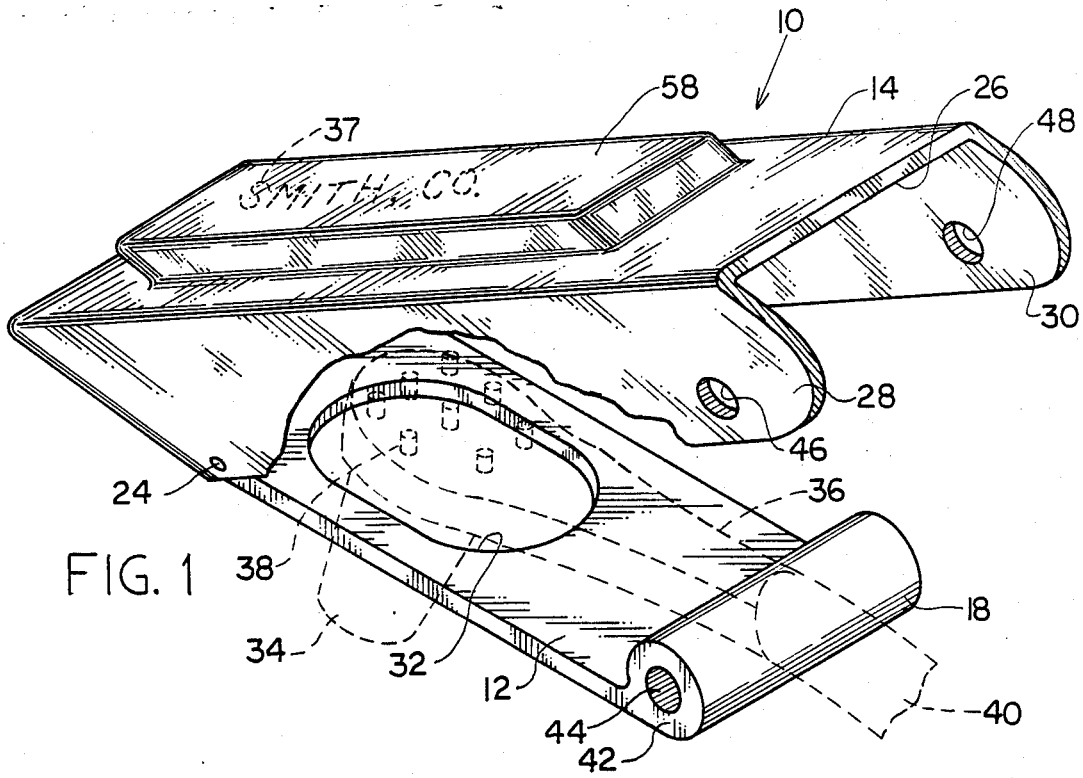
FIG. 1 is an isometric view of the beverage dispenser lock of the present invention showing the dispenser lock in the open position with a typical beverage dispenser being shown in phantom connecting with the dispenser lock of the present invention.

Referring particularly to the drawing, there is shown the beverage dispenser lock 10 of this invention which is composed primarily of a base plate 12 and a cover 14. Normally, both the cover 14 and the base plate 12 will be constructed of a rigid material with generally a plastic being preferred. However, metallic materials may also be desirable such as aluminum or steel.

The base plate 12 is constructed of sheet material and when observed from the top view is basically rectangular. The base plate 12 has an upper edge 16 and a lower edge 18. Within the base plate 12 and located directly adjacent the upper edge 16 are a pair of holes 20. There is to be a hole 20 connecting with each side edge of the base plate 12. Holes 20 are to be aligned with each other and each hole 20 is to have mounted therein a hinge pin 22. It is to be noted that in referring to the drawing, there is only one hole 20 shown and one hinge pin 22 shown. But it is to be understood that there will be a similar hole 20 and hinge pin 22 mounted on the opposite side edge of the base plate 12.

Figure 3:
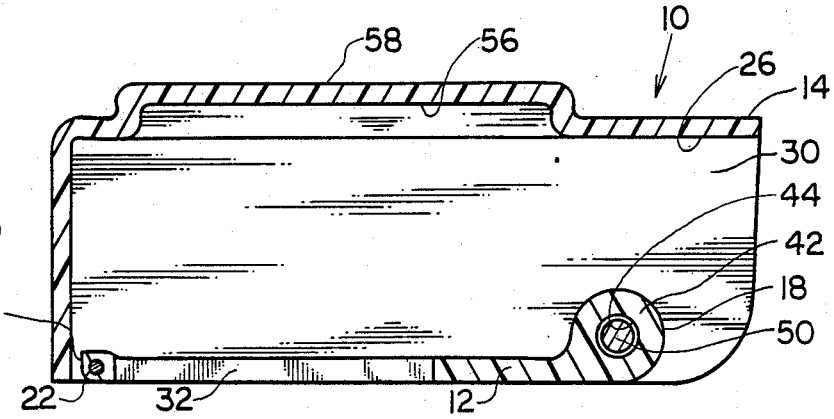
FIG. 3 is a cross-sectional view taken along line 3—3 of FIG. 2.

Each of the hinge pins 22 are to protrude slightly from their respective hole 20 and each hinge pin 22 is to connect with a hole 24 formed within each side wall 28 and 30 of the cover 14. It is to be understood that the cover 14 is channel shaped forming an interior chamber 26 which is confined by the side walls 28 and 30. The hole 24 is only shown within the side wall 28. However, it is to be understood that therre will be a similar hole 24 formed within the side wall 30 with these holes 24 being in longitudinal alignment. It can thusly be seen that the cover 14 is capable of hinging relative to the base plate 12 between the open position shown in FIG. 1 to the closed position shown in FIG. 3.

Within the base plate 12 is formed an enlarged opening 32. This enlarged opening 32 is to connect with the spout 34 of a housing 36 of a beverage dispenser. Mounted on the housing 36 of the beverage dispenser are a plurality of buttons 38. Manual depressing of a button 38 will result in the conducting of a particular beverage through flexible beverage supply conduit 40 through the spout 34 to be dispensed within an appropriate location such as a glass or other similar type of container. The beverage dispenser is to be movable into and out of the connection with the enlarged opening 32 only when the cover 14 is in the open position. It is to be understood that the beverage dispenser 36 will be connected with the dispenser lock 10 of this invention only when it is not intended to be used such as overnight.

Figure 2:
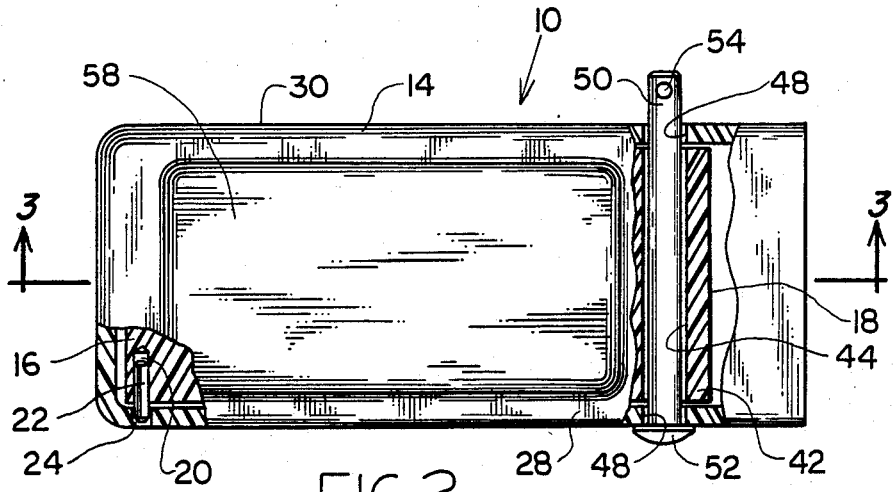
FIG. 2 is a top plan view, partially cut away, of the dispenser lock of the present invention showing the dispenser lock in the closed position.

At the end 18 of the base plate 12 there is located a barrel 42. Barrel 42 is basically cylindrical and has a constant diameter, open-ended, through opening 44 formed therein. Within the side wall 28 is formed a hole 46. Within the side wall 30 is formed a hole 48. When the cover 14 is located in the closed position, holes 46 and 48 align with the opening 44. With the cover 14 in a closed position, a locking pin 50 is to be inserted through the opening 44 and the aligned holes 46 and 48 with such insertion being clearly depicted in FIG. 2 of the drawing. The inner end of the locking pin 50 includes an enlarged head 52. The outer end of the pin 50 includes a hole 54. It is this hole 54 that is to connect with some separate type of locking mechanism (not shown) in order to prevent unauthorized removal of the locking pin 50. A typical separate locking mechanism would be a padlock with the shackle (not shown) of the padlock to connect with the hole 54.

When the cover 14 is in the closed position, the buttons 38 of the beverage dispenser are to be located within the recessed area 56 of the raised section 58 of the cover 14. With the buttons 38 located within the recessed area 56, activation of the buttons 38, either accidentally or on purpose, is prevented. The raised section 58 includes a basically planar exterior surface. It is on this planar exterior surface there may be inscribed some type of indicia 37 such as an identifying name or number.

It is to be understood that the pin 50 is to be removed from the opening 44 and the aligned holes 46 and 48 in order for the cover 14 to be moved to the open position. It is also to be thusly seen that when the cover 14 is in the closed position the beverage dispenser is captured and held in place within the internal chamber 26.

What is claimed is:

1. In combination with a hand holdable beverage dispenser for dispensing a plurality of different beverages, said beverage dispenser having a handle section and a spout section, a flexible beverage supply conduit connecting with said handle section, manually activatable means mounted on said handle section for selecting and causing a particular beverage to be dispensed through and from said spout section, a dispenser lock comprising:

a base plate having an enlarged opening, said base plate having an upper edge and an oppositely located lower edge;

an enclosing cover defining an interior chamber, said cover having a top edge and an oppositely located bottom edge;

a hinge connection between said cover and said base plate, said hinge connection located directly adjacent said top edge and said upper edge, said cover being pivotable relative to said base plate between an open position and a closed position, with said cover in said open position said beverage dispenser to be insertable into and removable from said interior chamber, with said beverage dispenser located in said interior chamber said spout section being located within said enlarged opening, when said cover is in said closed position said beverage dispenser is confined within said interior chamber; and disengageable locking means connecting said cover and said base plate, said locking means located directly adjacent said bottom edge and said lower edge, activation of said locking means fixes said cover in said closed position.

2. The combination as defined in claim 1 wherein:

said top edge being closed, said bottom edge being open, said flexible beverage supply conduit being conductable through said open bottom edge.

3. The combination as defined in claim 2 wherein:

said locking means comprising a pin, said pin adapted to be connected by a separate locking mechanism.

4. The combination as defined in claim 3 wherein:

said cover including a raised section, said raised section defining an exterior surface receptive to name identifying indicia.

* * * * *